US007490358B1

(12) United States Patent
Beck

(10) Patent No.: US 7,490,358 B1
(45) Date of Patent: Feb. 17, 2009

(54) BACK ARMOR

(75) Inventor: Jason R. Beck, Peoria, AZ (US)

(73) Assignee: Diamondback Tactical L.L.L.P., Phoenix, AZ (US)

( * ) Notice: Subject to any disclaimer, the term of this patent is extended or adjusted under 35 U.S.C. 154(b) by 0 days.

(21) Appl. No.: 11/202,637

(22) Filed: Aug. 11, 2005

Related U.S. Application Data

(60) Provisional application No. 60/689,235, filed on Jun. 10, 2005, provisional application No. 60/601,334, filed on Aug. 13, 2004.

(51) Int. Cl.
*F41H 1/02* (2006.01)
*A41D 1/04* (2006.01)
*F41H 1/00* (2006.01)
*A41D 27/00* (2006.01)

(52) U.S. Cl. ..... 2/2.5; 2/102; 2/467; 2/92

(58) Field of Classification Search ..... 2/2.5, 2/464, 467, 92, 102, 326–332, 338, 900
See application file for complete search history.

(56) References Cited

U.S. PATENT DOCUMENTS

| | | | |
|---|---|---|---|
| 264,195 | A | 9/1882 | Quinn, Jr. |
| 562,608 | A | 6/1896 | Herberlin |
| 642,244 | A | 1/1900 | Oldham |
| 761,113 | A | 5/1904 | Van Wagoner et al. |
| 842,498 | A | 1/1907 | Schmidt |
| 921,352 | A | 5/1909 | Blakers et al. |
| 1,044,494 | A | 11/1912 | Clarke |
| 1,210,407 | A | 1/1917 | Boucher |
| 1,246,274 | A | 11/1917 | Jelalian |
| 1,256,422 | A | 2/1918 | Anderson |
| 1,269,019 | A | 6/1918 | Szmyt |
| 1,310,125 | A | 7/1919 | Lundberg et al. |
| 1,348,204 | A | 8/1920 | Brewster |
| 1,350,062 | A | 8/1920 | Brewster |
| 1,655,895 | A | 1/1928 | Davis |
| 1,758,296 | A | 5/1930 | Schaumann |
| 1,764,483 | A | 6/1930 | Watkins |
| 1,772,922 | A | 8/1930 | Volz |
| 1,968,767 | A | 7/1934 | Howard |
| 2,099,431 | A | 11/1937 | Reeb |
| 2,266,886 | A | 12/1941 | McCoy |
| 2,343,142 | A | 2/1944 | Freedman |
| 2,448,416 | A | 8/1948 | Carter |
| 2,557,445 | A | 6/1951 | Lewallen |

(Continued)

FOREIGN PATENT DOCUMENTS

| | | |
|---|---|---|
| DE | 4214543 | 11/1993 |

(Continued)

*Primary Examiner*—Bobby H Muromoto, Jr.
(74) *Attorney, Agent, or Firm*—Snell & Wilmer LLP.

(57) ABSTRACT

A lower back protection system is provided by a lower back protection apparatus for protecting the lower back region of a user, the apparatus comprising a first piece of lower back armor; a first strap coupled with the lower back armor; a second strap coupled with the lower back armor; wherein the first strap and the second strap are configured to couple the first piece of lower back armor with an article of clothing so as to provide armored back protection to the user when the article of clothing is being worn by the user.

18 Claims, 5 Drawing Sheets

U.S. PATENT DOCUMENTS

| | | | | | |
|---|---|---|---|---|---|
| 2,755,566 | A | | 7/1956 | Harrison | |
| 3,331,083 | A | | 7/1967 | Holly | |
| 3,529,307 | A | | 9/1970 | Nelson et al. | |
| 3,577,836 | A | | 5/1971 | Tamura | |
| 3,743,147 | A | | 7/1973 | Wilczynski | |
| 3,840,901 | A | | 10/1974 | Eyster | |
| 3,957,183 | A | | 5/1976 | Gadberry | |
| 4,106,121 | A | | 8/1978 | Benson | |
| 4,180,261 | A | | 12/1979 | Kolka | |
| 4,194,656 | A | | 3/1980 | Zufich | |
| 4,266,300 | A | | 5/1981 | Partridge | |
| 4,287,607 | A | | 9/1981 | Leach | |
| 4,302,847 | A | * | 12/1981 | Miles | 2/465 |
| 4,307,826 | A | | 12/1981 | Stewart | |
| 4,318,502 | A | | 3/1982 | Lowe et al. | |
| 4,425,667 | A | * | 1/1984 | Harrison | 2/462 |
| 4,475,247 | A | * | 10/1984 | Lee | 2/2.5 |
| 4,497,069 | A | * | 2/1985 | Braunhut | 2/2.5 |
| 4,507,802 | A | * | 4/1985 | Small | 2/2.5 |
| 4,507,882 | A | | 4/1985 | Harrell | |
| 4,584,228 | A | | 4/1986 | Droste | |
| 4,601,067 | A | * | 7/1986 | Buonassissi | 2/102 |
| 4,602,385 | A | * | 7/1986 | Warren | 2/2.14 |
| 4,605,335 | A | | 8/1986 | Otrusina | |
| 4,645,103 | A | * | 2/1987 | Bianchi et al. | 224/243 |
| 4,645,465 | A | | 2/1987 | Courtney | |
| 4,651,355 | A | | 3/1987 | White | |
| 4,923,105 | A | | 5/1990 | Snyder | |
| 4,973,277 | A | | 11/1990 | Khanamirian | |
| 4,999,850 | A | | 3/1991 | Grilliot et al. | |
| 5,014,359 | A | | 5/1991 | Hanson | |
| 5,016,794 | A | | 5/1991 | Beagle, Jr. | |
| 5,023,953 | A | | 6/1991 | Bettcher | |
| 5,025,965 | A | | 6/1991 | Smith | |
| 5,052,647 | A | | 10/1991 | Axelson et al. | |
| 5,054,127 | A | | 10/1991 | Zevchak | |
| 5,060,314 | A | | 10/1991 | Lewis | |
| 5,063,127 | A | | 11/1991 | Oka et al. | |
| 5,063,614 | A | | 11/1991 | McSheffery | |
| 5,072,453 | A | | 12/1991 | Widder | |
| 5,073,985 | A | * | 12/1991 | Stone et al. | 2/2.5 |
| 5,090,053 | A | | 2/1992 | Hayes | |
| 5,184,763 | A | | 2/1993 | Blaisdell et al. | |
| 5,201,448 | A | | 4/1993 | Schue | |
| 5,215,379 | A | | 6/1993 | Pickard et al. | |
| 5,247,707 | A | | 9/1993 | Parker et al. | |
| 5,259,093 | A | | 11/1993 | D'Annunzio | |
| 5,325,538 | A | * | 7/1994 | Schoenweiss et al. | 2/2.5 |
| 5,327,811 | A | * | 7/1994 | Price et al. | 89/36.05 |
| 5,331,683 | A | * | 7/1994 | Stone et al. | 2/2.5 |
| 5,349,893 | A | | 9/1994 | Dunn | |
| 5,398,340 | A | * | 3/1995 | Kibbee | 2/2.5 |
| 5,421,032 | A | | 6/1995 | Murphy | |
| 5,431,318 | A | * | 7/1995 | Garcia | 224/192 |
| 5,465,425 | A | | 11/1995 | Crispin | |
| 5,465,429 | A | * | 11/1995 | Rogers et al. | 2/300 |
| 5,471,906 | A | | 12/1995 | Bachner, Jr. et al. | |
| 5,488,738 | A | * | 2/1996 | Seamans | 2/69 |
| 5,495,621 | A | * | 3/1996 | Kibbee | 2/2.5 |
| 5,512,348 | A | | 4/1996 | Mazelsky | |
| 5,534,343 | A | | 7/1996 | Landi et al. | |
| 5,549,495 | A | * | 8/1996 | Burnworth et al. | 441/108 |
| 5,589,254 | A | | 12/1996 | Dischler | |
| 5,604,958 | A | | 2/1997 | Anscher | |
| 5,609,278 | A | | 3/1997 | Fresco | |
| 5,617,984 | A | | 4/1997 | Fabel | |
| 5,626,270 | A | | 5/1997 | Tseng | |
| 5,628,064 | A | | 5/1997 | Chung | |
| 5,639,005 | A | | 6/1997 | Chouinard | |
| 5,644,792 | A | * | 7/1997 | Tishler et al. | 2/2.5 |
| 5,724,707 | A | | 3/1998 | Kirk et al. | |
| 5,754,982 | A | * | 5/1998 | Gainer | 2/2.5 |
| 5,765,738 | A | | 6/1998 | Hoffner | |
| 5,797,140 | A | * | 8/1998 | Davis et al. | 2/2.5 |
| 5,806,741 | A | | 9/1998 | Kirk | |
| 5,829,653 | A | * | 11/1998 | Kaiser | 224/577 |
| 5,875,944 | A | | 3/1999 | Beletsky | |
| 5,903,920 | A | | 5/1999 | Granqvist | |
| 5,918,309 | A | | 7/1999 | Bachner, Jr. | |
| 5,943,694 | A | * | 8/1999 | Moureaux et al. | 2/2.5 |
| 5,966,747 | A | * | 10/1999 | Crupi et al. | 2/466 |
| 5,974,585 | A | * | 11/1999 | Bachner, Jr. | 2/2.5 |
| 5,987,650 | A | | 11/1999 | Carroll | |
| 5,991,925 | A | * | 11/1999 | Wu | 2/102 |
| 6,012,162 | A | | 1/2000 | Bullat | |
| 6,088,831 | A | * | 7/2000 | Jensen et al. | 2/2.5 |
| 6,103,641 | A | | 8/2000 | Gehring, Jr. | |
| 6,138,277 | A | | 10/2000 | Gillen et al. | |
| 6,161,222 | A | | 12/2000 | Strickland | |
| 6,161,741 | A | | 12/2000 | French | |
| 6,164,048 | A | | 12/2000 | Rhodes | |
| 6,182,288 | B1 | * | 2/2001 | Kibbee | 2/2.5 |
| 6,185,738 | B1 | * | 2/2001 | Sidebottom | 2/2.5 |
| 6,185,742 | B1 | * | 2/2001 | Doherty | 2/81 |
| 6,233,737 | B1 | * | 5/2001 | Ditchfield et al. | 2/2.5 |
| 6,233,740 | B1 | | 5/2001 | Meyers et al. | |
| 6,264,079 | B1 | | 7/2001 | Skaggs | |
| 6,266,818 | B1 | * | 7/2001 | Howland et al. | 2/2.5 |
| 6,279,804 | B1 | | 8/2001 | Gregg | |
| 6,319,862 | B1 | | 11/2001 | Czetto, Jr. | |
| D452,047 | S | * | 12/2001 | Ditchfield et al. | D29/100 |
| D455,548 | S | | 4/2002 | Cragg | |
| 6,431,420 | B1 | | 8/2002 | Cragg | |
| 6,449,769 | B1 | | 9/2002 | Bachner, Jr. | |
| 6,453,791 | B1 | | 9/2002 | Seitzinger | |
| 6,516,981 | B2 | | 2/2003 | Perez et al. | |
| 6,519,775 | B1 | | 2/2003 | Garcia | |
| 6,543,055 | B2 | * | 4/2003 | Howland et al. | 2/2.5 |
| 6,547,118 | B2 | | 4/2003 | Beletsky et al. | |
| 6,588,640 | B1 | | 7/2003 | Rogers et al. | |
| 6,627,562 | B1 | | 9/2003 | Gehring, Jr. | |
| 6,634,531 | B2 | | 10/2003 | Conte | |
| 6,681,400 | B1 | * | 1/2004 | Mills | 2/2.5 |
| 6,685,066 | B2 | | 2/2004 | Cragg | |
| 6,691,906 | B2 | | 2/2004 | Cragg | |
| 6,698,024 | B2 | | 3/2004 | Graves et al. | |
| 6,703,104 | B1 | | 3/2004 | Neal | |
| 6,704,934 | B2 | | 3/2004 | Graham et al. | |
| 6,738,984 | B2 | | 5/2004 | Gillen et al. | |
| D496,143 | S | | 9/2004 | Noell et al. | |
| D500,807 | S | | 1/2005 | Noell et al. | |
| D501,592 | S | | 2/2005 | Noell et al. | |
| D501,989 | S | | 2/2005 | Cook et al. | |
| D501,991 | S | | 2/2005 | Cook et al. | |
| 6,851,160 | B2 | | 2/2005 | Carver | |
| D503,039 | S | | 3/2005 | Cook et al. | |
| 6,892,392 | B2 | * | 5/2005 | Crye et al. | 2/2.5 |
| D505,773 | S | | 6/2005 | Noell et al. | |
| D505,774 | S | | 6/2005 | Noell et al. | |
| 6,907,617 | B2 | | 6/2005 | Johnson | |
| 6,961,957 | B2 | * | 11/2005 | Carlson | 2/2.5 |
| 6,981,624 | B2 | * | 1/2006 | Link et al. | 224/674 |
| 7,020,897 | B2 | * | 4/2006 | Johnson | 2/102 |
| 7,047,570 | B2 | * | 5/2006 | Johnson | 2/102 |
| 2002/0120973 | A1 | | 9/2002 | D'Annunzio | |
| 2003/0104738 | A1 | | 6/2003 | Porter | |
| 2003/0141328 | A1 | | 7/2003 | Cragg | |
| 2004/0016784 | A1 | | 1/2004 | Berry | |
| 2004/0035900 | A1 | | 2/2004 | Cragg | |
| 2004/0045428 | A1 | | 3/2004 | Citerrio | |
| 2004/0112932 | A1 | | 6/2004 | Cragg | |
| 2004/0132368 | A1 | | 7/2004 | Price et al. | |
| 2004/0221361 | A1 | | 11/2004 | D'Annunzio | |
| 2004/0226972 | A1 | | 11/2004 | Cook | |

| | | | |
|---|---|---|---|
| 2004/0238571 | A1 | 12/2004 | Noell et al. |
| 2005/0005342 | A1 | 1/2005 | Johnson |
| 2005/0005343 | A1 | 1/2005 | Johnson |
| 2005/0035162 | A1 | 2/2005 | Lowe et al. |

FOREIGN PATENT DOCUMENTS

| | | |
|---|---|---|
| EP | 0226265 | 6/1987 |
| FR | 2391446 | 5/1978 |
| FR | 2699265 | 12/1992 |
| GB | 425066 | 3/1935 |
| JP | 3019650 | 11/1995 |
| JP | 136190 | 5/1996 |
| JP | 2000008208 | 1/2000 |
| JP | 2000193396 | 7/2000 |
| JP | 2000282307 | 10/2000 |
| JP | 2001235299 | 8/2001 |
| JP | 2002173383 | 11/2003 |
| JP | 2003329396 | 11/2003 |
| WO | WO 92/08094 | 5/1992 |
| WO | WO 92/13250 | 8/1992 |
| WO | WO 00/28273 | 5/2000 |

* cited by examiner

BACK ARMOR

CROSS-REFERENCES TO RELATED APPLICATIONS

This application claims the benefit under 35 U.S.C. §119 (e) of 60/601,334, entitled "Body Armor", filed on Aug. 13, 2004, and also claims the benefit under 35 U.S.C. §119(e) of 60/689,235, entitled "Back Armor", filed on Jun. 10, 2005, the contents of which are hereby incorporated by reference in their entirety and for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

One embodiment of the invention relates generally to back armor. For example, one embodiment of the invention focuses on lower back armor.

BACKGROUND

It has been common in the past to provide protection to the chest and upper back regions of a user by way of a ballistic vest. Such vests utilize strike plates or soft body armor positioned in the chest area and upper back area. However, the vests do not extend below the waist of a user so as to allow freedom of movement when the user is wearing the vest. This is particularly true when rigid strike plates are utilized in the vest, as such strike plates provide no flexibility when the user wears the vest.

As a result, such vests do not provide protection for the lower back region of a user. Thus, a user is exposed to serious injury from bullets, fragmentation, or blast waves in this lower back region. Notably, the lower back region houses the kidneys and lower spine, thus wounds to this area can result in significant harm to an operator.

Thus, there is a need for a system that provides lower back protection while still allowing flexibility for an operator.

SUMMARY

According to one embodiment of the invention a lower back protection apparatus is provided for protecting the lower back region of a user. The apparatus comprises a first piece of lower back armor; a first strap coupled with the lower back armor; a second strap coupled with the lower back armor; wherein the first strap and the second strap are configured to couple the first piece of lower back armor with an article of clothing so as to provide armored back protection to the user when the article of clothing is being worn by the user.

Furthermore, another embodiment of the invention provides a lower back protection apparatus for protecting the lower back region of a user. The apparatus comprises a first back armor carrier comprising a cavity configured for receiving an armor plate configured for protecting the back of a user; a first coupling device coupled with the armor carrier and configured for coupling the armor carrier with an article of clothing; wherein the armor carrier is configured as a modular unit so as to permit removal and recoupling of the armor carrier with the article of clothing in multiple positions so as to provide lower back protection.

Yet another embodiment of the invention provides a lower back protection apparatus that comprises a first section of lower back armor comprising a first armor carrier; a first section of armor disposed in the first armor carrier; a second section of lower back armor comprising a second armor carrier; a second section of armor disposed in the second armor carrier; a coupling device configured to couple the first section of lower back armor with the second section of lower back armor so as to allow the second section of lower back armor to articulate relative to the first section of lower back armor; and wherein the coupling device is coupled to the midsection region of the outwardly facing external surface of the first armor carrier when the armor carrier is being worn.

In addition, a kit of materials can be provided such as a kit of materials for assembly in the field. The kit can be comprised of a vest configured to be worn by a user; a first modular back armor protection device configured to provide ballistic protection and configured to be coupled with the vest so as to provide ballistic protection for the back region of the user when worn by the user.

DESCRIPTION

Figure 1:
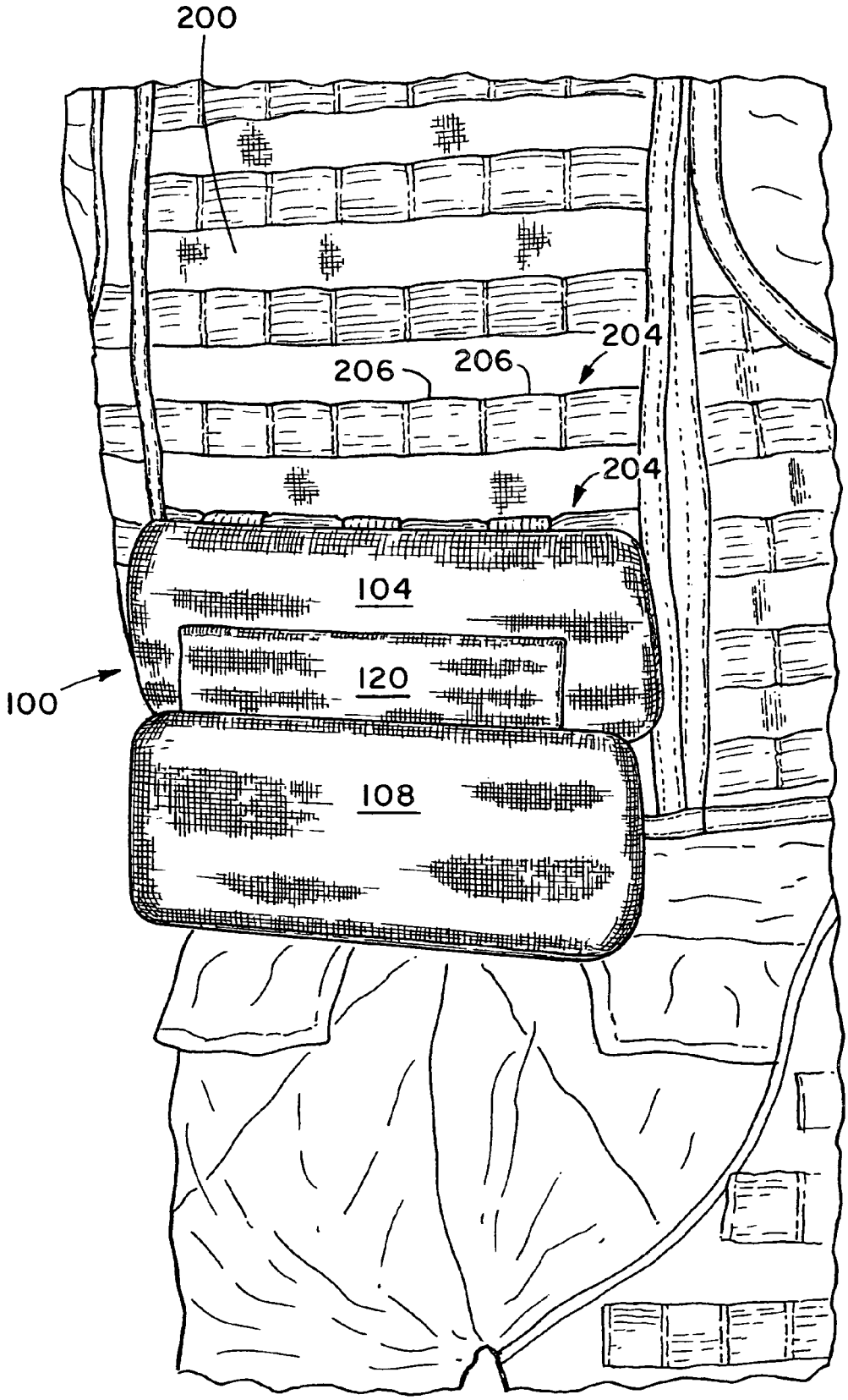
FIG. 1 illustrates a perspective view of a lower back protection apparatus coupled with a ballistic vest being worn by a user, according to one embodiment of the invention.

Referring now to FIG. 1, an exemplary lower back protector 100 can be seen. FIG. 1 illustrates a ballistic vest 200 worn by an operator that is coupled with the lower back protection apparatus 100. The lower back protector is shown comprised of a first piece of lower back armor 104 coupled with the vest as well as coupled with a second free hanging piece of lower back armor 108. A coupling strap 120 couples the second piece of lower back armor with the first piece of lower back armor so as to permit freedom of movement when the user bends or sits. Thus, the second piece of lower back armor can provide lower back protection while the user is standing or moving. Yet, when the user sits or is obstructed by a stationary object, the second piece of lower back armor can articulate upwards as well as partially sideways. Thus, the lower back armor provides a continuous protection that extends below the upper back armor provided by the ballistic vest. FIG. 1 also shows a modular webbing system comprised of webbing strips 204 that are sewn to the nylon backing of the ballistic vest at regular intervals so as to establish loops 206.

Figure 2:
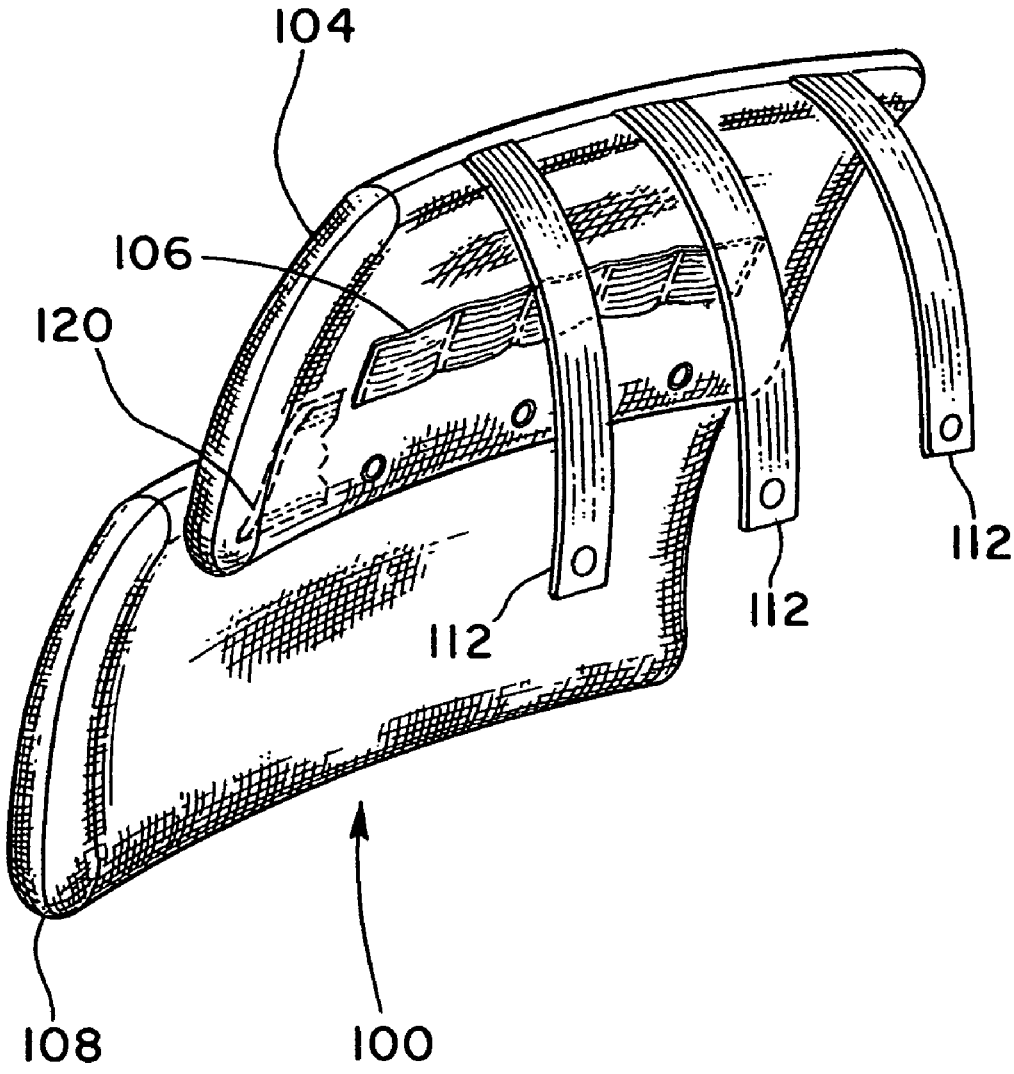
FIG. 2 illustrates a perspective view of a lower back protection apparatus according to one embodiment of the invention.

Referring now to FIG. 2, a perspective view of a lower back protector can be seen. A first piece of lower back armor 104 is shown coupled with a second piece of lower back armor 108. A coupling device such as a broad strap 120 sewn to the first piece of lower back armor and second piece of lower back armor couples these pieces together in FIG. 2. Furthermore, straps 112 are shown coupled with the first piece of lower back armor in FIG. 2. These straps, as will be seen, allow the lower back armor to be coupled with a ballistic vest, for example. Furthermore, the lower back armor system 100 is shown with a strip of webbing 106 disposed on the inward facing portion of the first piece of lower back armor 104. This strip of webbing can also be utilized to secure the lower back armor to the ballistic vest, for example. In addition, an exemplary snap system is shown disposed below the strip of webbing in FIG. 2.

Figure 3:
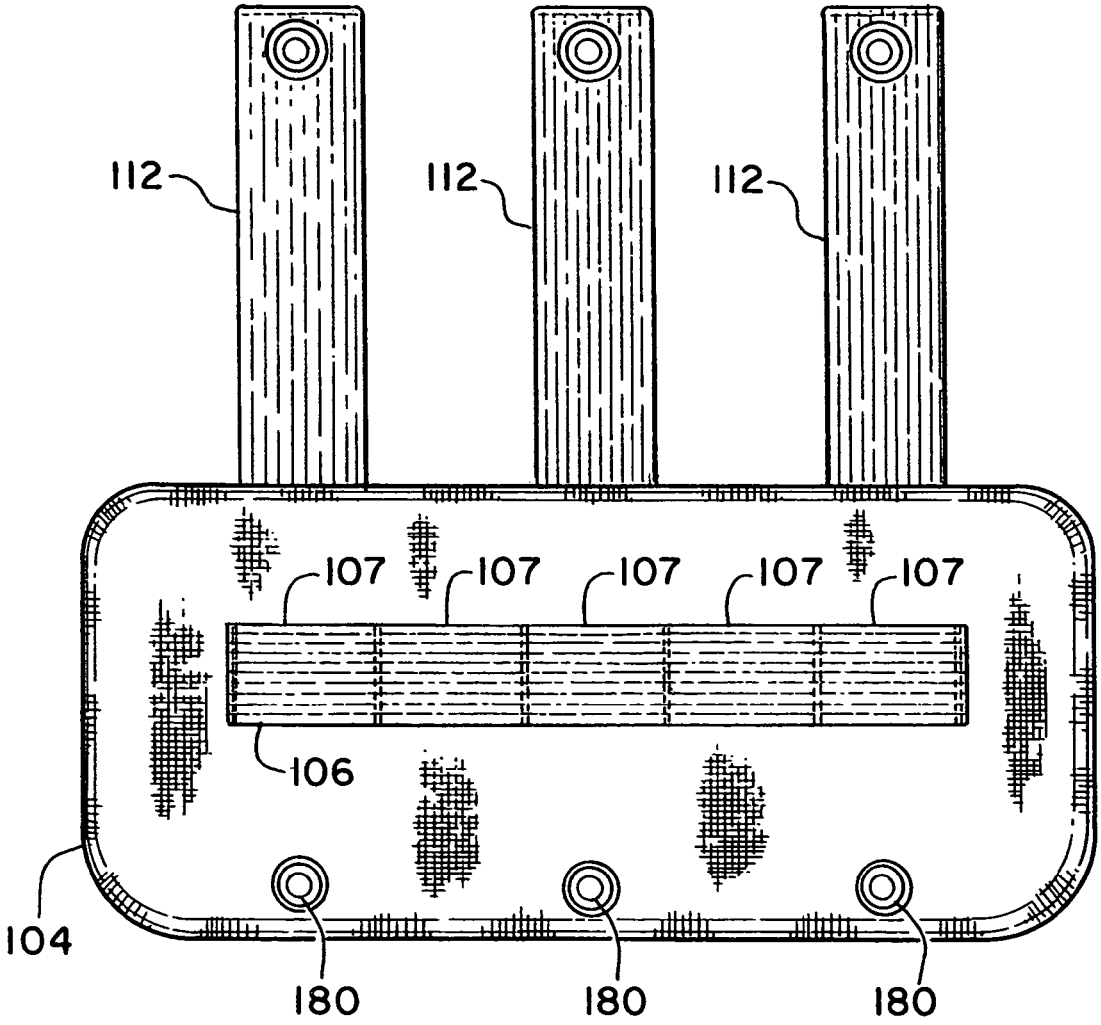
FIG. 3 illustrates a view of a lower back protection apparatus that can be coupled with an article of clothing, according to one embodiment of the invention.

FIG. 3 illustrates a plan view of a first section of a lower back armor protector, according to one embodiment of the invention. This view shows the inner facing external surface of the first section of lower back armor, i.e., the side that faces the back of the user during use. Thus, first section 104 can have multiple coupling devices such as straps 112 sewn to the top of the first section of lower back armor. A durable material, such as high-strength nylon (e.g., 100 denier), can be utilized for holding the armor utilized for the first section of lower back armor 104. Thus, the straps can be sewn to the nylon or coupled by a different coupling system. FIG. 3 also shows a strip of webbing 106 disposed on the surface of the first section of lower back armor. For example, this can be accomplished by sewing a strip of nylon at regular intervals to the first section of lower back armor 104. This allows loops 107 to be established for coupling purposes. Finally, FIG. 3 shows snap portions 180 which can be utilized in one embodiment of the invention to couple straps 112 with the bottom portion of the lower back armor once the straps have been weaved through loops on the article of clothing to which the lower back armor is being coupled.

Figure 4:
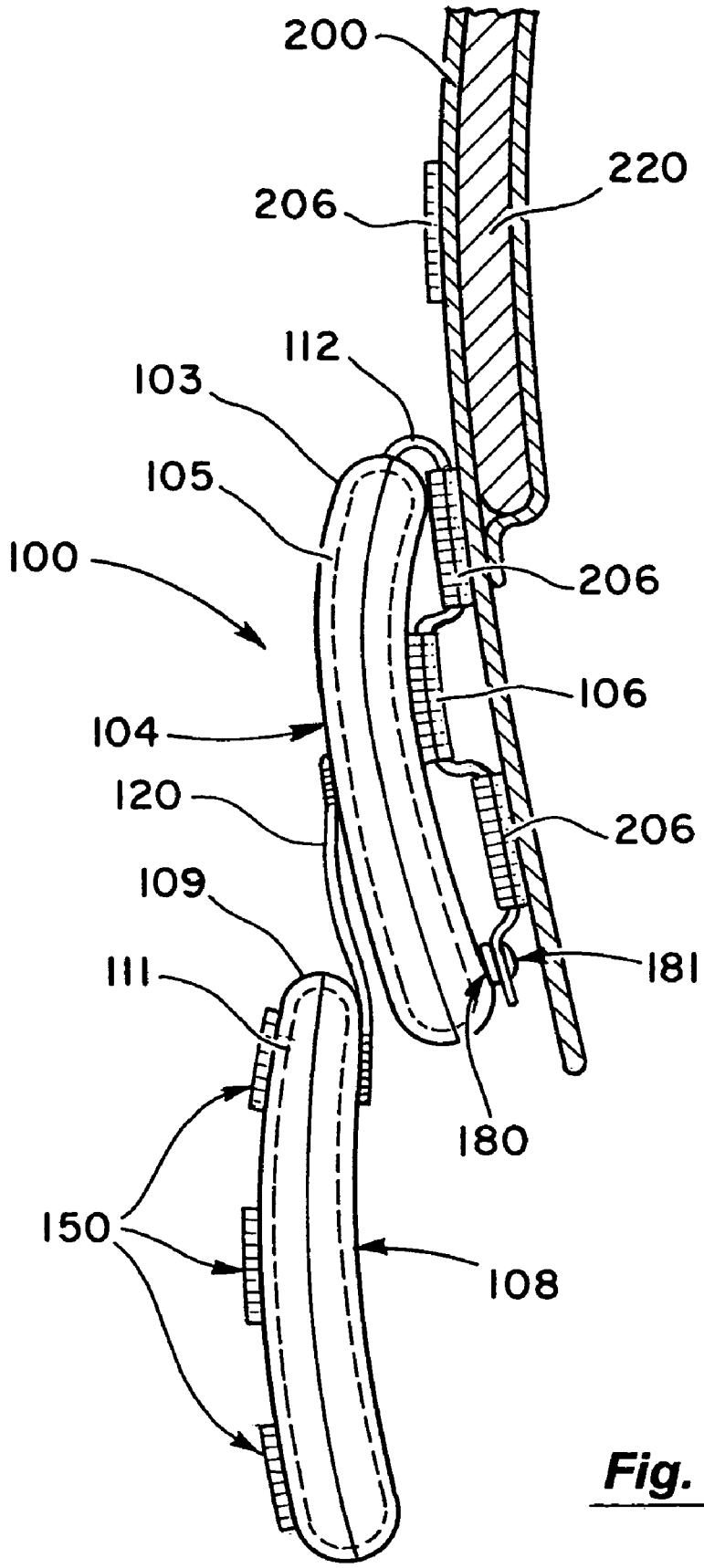
FIG. 4 illustrates a side view of a lower back protection apparatus coupled with a ballistic vest, according to one embodiment of the invention.

Referring now to FIG. 4, a side view of a two piece lower back armor protection system 100 can be seen. FIG. 4 illustrates a lower back armor protector coupled with a ballistic vest 200. This side view shows an exemplary piece of armor 220 positioned in the ballistic vest. FIG. 4 also shows a lower back armor protector coupled with the ballistic vest. The first section of lower back armor 104 is shown comprised of a first armor carrier 103 and a first section of armor 105, such as an armor plate, disposed in the armor carrier. This can be achieved by forming a cavity from durable nylon, such as Cordura™ nylon and positioning the armor plate, such as a strike plate, within the cavity. The nylon can then be sewn closed or releasably closed if a pocket system is utilized. A pocket system would permit replacement of the strike plate with soft body armor, for example, which might be preferable in certain tactical situations. Dashed line 105 in FIG. 4 illustrates the first section of armor disposed in the first armor carrier. Similarly, a second section of lower back armor 108 is shown configured from a second armor carrier 109 and a second section of back armor 111 disposed within the second armor carrier 109. The first section of lower back armor and the second section of lower back armor are shown coupled with each other via a coupling system such as strap 120. An exemplary strap can further be seen in FIG. 1. Notably, the strap 120 is coupled on the first section of lower back armor at approximately a mid-point along the first section of lower back armor. This flexible strap which can be made from a durable piece of nylon, for example, allows the second section of lower back armor to articulate upward when forced upward. Such a force might be from a user sitting down in a chair or vehicle. Notably, the strap 120 is configured with a short enough length so as to provide continuous back protection for the user by not allowing the second section of back armor to hang down below the bottom end portion of the first section of back armor.

The first section of lower back armor is shown in FIG. 4 as having a strap 112 for coupling the first section of lower back armor with the ballistic vest 200. This can be accomplished by weaving the strap 112 through loops of webbing 206 on the ballistic vest. Optionally, the strap can also be weaved through webbing 106 disposed on the inward facing external surface of the first section of lower back armor. This can provide a more secure fit. The strap can be coupled in a secure position by a snap mechanism illustrated by snap sections 180 and 181 in FIG. 4.

In addition to providing lower back protection, the lower back protector system shown in FIG. 4 also can provide additional mounting surface area for pieces of equipment. Thus, second section of back armor 108 shown in FIG. 4 is also shown having webbing strips 150. These webbing strips can be utilized to couple additional pieces of equipment with the second section of lower back armor. Thus, the lower back armor not only provides additional ballistic protection, it also provides additional carrying capability for an operator.

Figure 5:
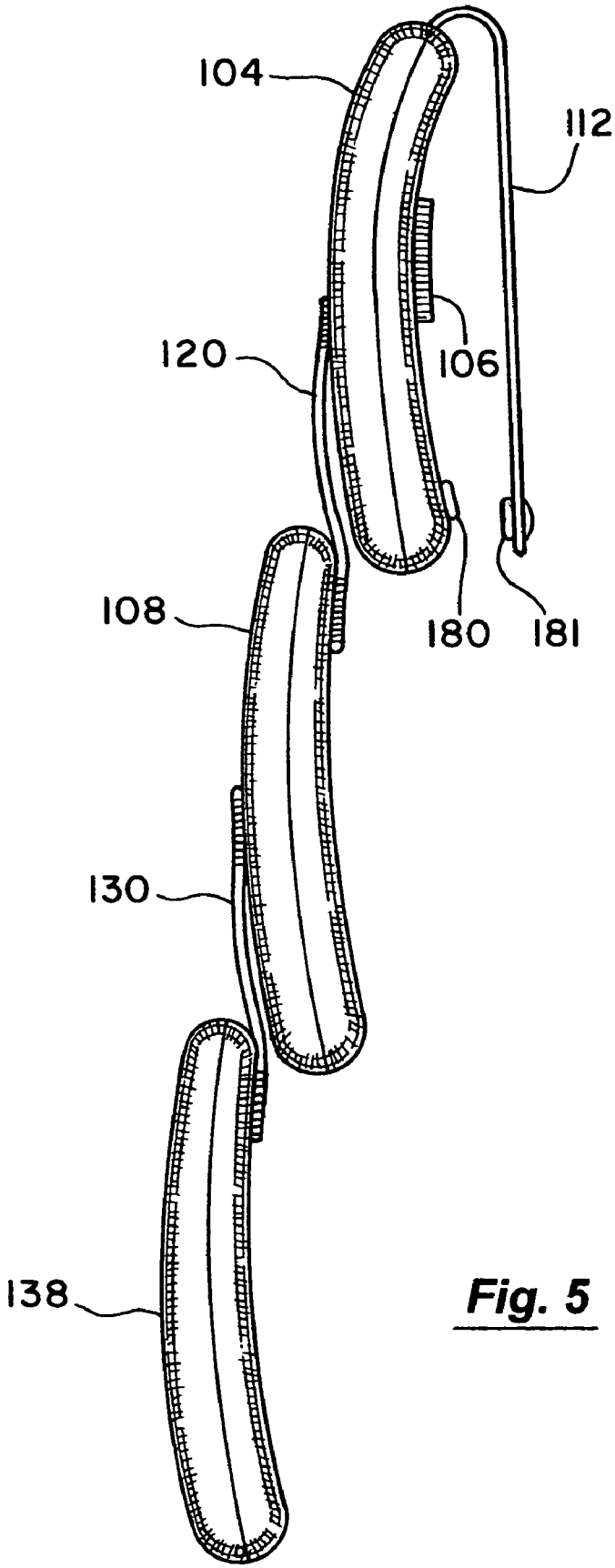
FIG. 5 illustrates a three piece lower back protection apparatus, according to one embodiment of the invention.

FIG. 5 illustrates yet another embodiment of the invention for long-waisted operators or for those in need of lengthier protection in the back region. Namely, a three section lower back armor protector system is shown in FIG. 5. This example shows a first section of lower back armor 104, a second section of lower back armor 108, and a third section of lower back armor 138 coupled with one another. Straps 120 and 130 couple the sections of lower back armor together so as establish a continuous region of protection for the lower back region. FIG. 5 also illustrates webbing strip 106 and coupling strap 112 for coupling the first section of lower back armor with a ballistic vest, for example. Snap system 180 and 181 can be utilized to secure strap 112 back to the first section of lower back armor.

It should be noted that the lower back armor protection system provides a modular system for coupling with an article of clothing such as a ballistic vest. Depending on the operation that an operator is being outfitted for, the lower back armor can be utilized or not utilized. The coupling system allows easy attachment and detachment from a ballistic vest, for example. Thus, an operator who is standing guard at a site may choose to wear the lower back armor with a vest, while an operator who is less exposed, such as riding in an armored vehicle, may choose not to wear the lower back armor. The modular aspect of the lower back armor system shown herein allows the operator to choose and thus provide the desired amount of ballistic protection under the circumstances.

It should also be noted that the lower back armor can be provided as a kit of materials that can be assembled by the operator in the field. For example, Diamondback Tactical 2004-2005 catalog, which is hereby incorporated herein by reference in its entirety for all purposes, shows additional pieces of equipment that can be coupled with an article of clothing. For example, it shows shoulder protectors, outer leg protectors, groin protectors, side armor, and other pieces of equipment that can be worn by a user in a tactical situation. Thus, these pieces of equipment can be provided or sold to an operator in a variety of combinations to provide ballistic protection for the user when the user assembles them in the field.

The lower back armor sections are shown with a radius of curvature. For example, a 20 inch radius of curvature can be utilized for a strike plate so as to provide sufficient ballistic protection. Thus, the armor carriers can be similarly configured so as to provide the same degree of radius of curvature when the armor plates are disposed within the armor carrier cavities.

The webbing strips can be configured in a standardized pattern so as to provide loops of material at regular intervals. Thus, for example, the webbing strips can be sewn at one and one-half inch intervals so as to provide loops of material having a width of approximately one and one-half inches. Thus, the straps 112 would similarly be configured so as to allow them to be weaved through loops of such size.

It is noted that many of the structures, materials, and acts recited herein can be recited as means for performing a function or steps for performing a function. Therefore, it should be understood that such language is entitled to cover all such structures, materials, or acts disclosed within this specification and their equivalents, including the matter incorporated by reference.

It is thought that the apparatuses and methods of the embodiments of the present invention and its attendant advantages will be understood from this specification. While the above is a complete description of specific embodiments of the invention, the above description should not be taken as limiting the scope of the invention as defined by the claims.

What is claimed is:

1. A lower back protection apparatus comprising:

a first section of lower back armor configured to provide ballistic protection, said first section having an outwardly-facing surface when worn by a user; and a second section of lower back armor configured to provide ballistic protection;

a strap connecting said first section of lower back armor to said second section of lower back armor, said strap secured to said outwardly-facing surface of said first section of lower back armor, said strap comprising a flexible material configured to collapse upon upward pressure exerted on said second section so as to allow the second section of lower back armor to move vertically relative to said first section of lower back armor;

a second strap coupled with said first section of lower back armor, said strap configured to couple with a plurality of loops arranged in a matrix configuration on a ballistic vest.

2. The lower back protection apparatus as claimed in claim 1 further comprising a ballistic vest, wherein said ballistic vest further comprises a plurality of horizontal webbing strips sewn to said ballistic vest at regular intervals in a matrix configuration so as to establish a plurality of loops configured to couple with said second strap.

3. The lower back protection apparatus as claimed in claim 1, wherein said second strap is configured with a width that is less than approximately 1.5 inches.

4. The lower back protection apparatus as claimed in claim 1 wherein said first section and said second section of lower back armor each comprise:

an armor carrier; and an armor plate in said armor carrier.

5. The lower back protection apparatus as claimed in claim 4 wherein said second section of lower back armor comprises a strip of webbing disposed on the inward facing portion of said first portion of lower back armor.

6. The lower back protection apparatus as claimed in claim 5, wherein said strip of webbing forms a plurality of loops configured to couple with said second strap.

7. A lower back protection apparatus comprising:

a first back armor carrier configured for receiving an armor plate configured to provide ballistic protection;

a second back armor carrier having a plurality of horizontal webbing strips each of said strips sewn at regular intervals on an outward facing external surface of said second back armor carrier so as to establish a plurality of loops, wherein said loops are vertically aligned so as to permit downwardly-extending insertion of a strap to carry additional equipment;

at least one coupling device coupled with said back armor carrier configured for coupling said back armor carrier with a ballistic vest, wherein said back armor carrier is configured as a modular unit so as to permit removal and recoupling of said armor carrier with a ballistic vest in a plurality of positions so as to provide lower back ballistic protection.

8. The lower back protection apparatus as claimed in claim 7 and further comprising:

an armor plate in said first and second back armor carriers.

9. The lower back protection apparatus as claimed in claim 8 wherein said armor plate in said armor carrier is configured to extend across the back region of a user.

10. The lower back protection apparatus as claimed in claim 8 wherein said armor plate comprises a radius of curvature.

11. The lower back protection apparatus claim 1 and further comprising:

at least one additional armor carrier coupled to said back armor carrier configured to provide additional ballistic protection.

12. The lower back protection apparatus claim 11 and further comprising:

a plurality of armor carriers coupled to said back armor carrier configured to provide additional ballistic protection.

13. A kit of materials for assembly in the field comprising:

a ballistic vest comprising a front portion coupled to a back portion configured to provide ballistic protection, said vest comprising a plurality of horizontal webbing strips, each of said horizontal strips sewn at intervals in a matrix configuration to the outwardly-facing surface of said ballistic vest so as to establish a plurality of vertically-oriented loops;

a first modular back armor protection device configured to provide ballistic protection removably coupled to said back portion of said ballistic vest, wherein said first modular back armor protection device comprises at least one cavity configured for receiving an armor plate configured to provide ballistic protection; and at least one coupling device for removably coupling said first modular back armor protection device to said back portion of said ballistic vest.

14. The kit of claim 13 further comprising a modular shoulder protector configured to provide ballistic protection coupled with said ballistic vest.

15. The kit of claim 13 further comprising a modular groin protector configured to provide ballistic protection coupled with said ballistic vest.

16. The kit of claim 13 further comprising an outer leg protector configured to provide ballistic protection coupled with said ballistic vest.

17. The lower back protection apparatus of claim 1, said strap coupled to the midsection region of the outwardly facing external surface of the first section of lower back armor.

18. The lower back protection apparatus of claim 1, wherein said strap is configured to extend horizontally across the length of said first section of back armor.

* * * * *